US010869561B2

(12) United States Patent
Arradondo et al.

(10) Patent No.: US 10,869,561 B2
(45) Date of Patent: Dec. 22, 2020

(54) RECONFIGURABLE MAGNETIC DISPLAY FIXTURE AND SYSTEM

(71) Applicant: TARGET BRANDS, INC., Minneapolis, MN (US)

(72) Inventors: Christine Arradondo, Saint Louis Park, MN (US); Jeremy A. Clark, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days.

(21) Appl. No.: 16/728,954

(22) Filed: Dec. 27, 2019

(65) Prior Publication Data

US 2020/0205586 A1 Jul. 2, 2020

Related U.S. Application Data

(60) Provisional application No. 62/786,103, filed on Dec. 28, 2018.

(51) Int. Cl.
*A47F 5/00* (2006.01)
*A47F 5/08* (2006.01)

(52) U.S. Cl.
CPC ..... *A47F 5/0006* (2013.01); *A47F 5/00* (2013.01); *A47F 5/08* (2013.01); *A47F 5/0823* (2013.01)

(58) Field of Classification Search
CPC ..... A47F 5/0815; A47F 5/0823; A47F 5/08; A47F 5/00; A47F 5/006; A47G 29/10
USPC ..... 211/90.01, DIG. 1, 54.1, 94.01; 248/220.31, 220.41, 220.42, 220.43, 248/206.5, 683
See application file for complete search history.

(56) References Cited

U.S. PATENT DOCUMENTS 2,346,582 A * 4/1944 Insler ..... 335/289
2,954,874 A * 10/1960 Rouse ..... A47G 29/10 211/85.9

(Continued)

FOREIGN PATENT DOCUMENTS

WO 03061435 A2 7/2003
WO 2011026949 A1 10/2011

(Continued)

*Primary Examiner* — Jonathan Liu
*Assistant Examiner* — Devin K Barnett
(74) *Attorney, Agent, or Firm* — JoAnn M. Seaton; Griffiths & Seaton PLLC

(57) ABSTRACT

A display fixture includes a magnetic focal wall and an auxiliary support member. The magnetic focal wall includes a magnetic panel, which is substantially planar, and a perforated panel, which is substantially planar and defines a plurality of perforations. The magnetic panel defines a front surface. The perforated panel is coupled with the magnetic panel such that the perforated panel extends in a substantially parallel plane with and in front of the magnetic panel. The auxiliary support member is configured to support a product thereon away from the magnetic focal wall and includes a magnet on a rear side thereof sized to fit within any one of the plurality of perforations such that the magnet of the auxiliary member is magnetically coupled with the magnetic panel through one of the plurality of perforations and the auxiliary support member extends forwardly from the perforated panel supported by the magnetic focal wall.

15 Claims, 15 Drawing Sheets

(56) References Cited

U.S. PATENT DOCUMENTS 2,965,235 A * 12/1960 Gordon ..... A47F 5/0823 211/1
3,482,709 A * 12/1969 Larson ..... A47F 5/0815 211/187
3,723,928 A * 3/1973 Blakey ..... B23Q 3/1546 335/285
3,744,868 A * 7/1973 Reiter ..... A47B 47/06 312/263
4,337,860 A * 7/1982 Carrigan ..... B25H 3/003 206/376
4,405,108 A * 9/1983 Muirhead ..... A47F 5/0823 211/70.6
4,687,094 A * 8/1987 Allsop ..... A47F 5/0823 206/45.26
4,723,663 A * 2/1988 Learn ..... A47F 5/0823 211/59.2
5,215,200 A * 6/1993 Rosenthal ..... A47F 5/0823 211/187
5,377,820 A * 1/1995 Christman ..... A47F 5/0807 206/495
5,660,286 A * 8/1997 Shea ..... A47F 5/08 211/189
5,743,394 A * 4/1998 Martin ..... B25H 3/003 206/378
5,785,187 A * 7/1998 Lipman ..... A47F 5/0815 211/54.1
5,813,550 A * 9/1998 Sheehan ..... A47F 5/0807 211/87.01
5,961,082 A * 10/1999 Walter ..... A47F 5/0807 211/87.01
6,003,685 A * 12/1999 Malin ..... A47F 5/0861 211/59.1
6,085,916 A * 7/2000 Kovacevic ..... A47F 7/24 211/86.01
6,199,706 B1 * 3/2001 Shea ..... A47F 5/08 211/103
6,334,540 B1 * 1/2002 Plutsky ..... A47F 5/083 211/43
6,574,924 B2 * 6/2003 Maniezzo ..... A47F 5/0823 211/90.01
6,581,788 B1 * 6/2003 Winig ..... A47B 96/027 211/183
6,598,752 B1 * 7/2003 Davidov ..... G11B 33/0411 211/40
6,811,127 B1 * 11/2004 Shiao ..... B25H 3/04 211/70.6
7,424,958 B1 * 9/2008 Eley ..... B25H 3/04 211/70.6
7,441,736 B2 * 10/2008 Wiltfang ..... A47F 5/0823 211/87.01
7,726,974 B2 * 6/2010 Shah ..... H05B 47/175 439/40
7,806,236 B2 * 10/2010 Scholen ..... A47F 5/0087 186/52
7,954,648 B2 * 6/2011 Takashima ..... A47F 5/0846 211/59.3
8,042,700 B1 * 10/2011 Smalley ..... A47F 5/0807 211/90.01
8,096,520 B2 * 1/2012 Sohn ..... A47B 96/06 248/558
D693,409 S * 11/2013 Clark ..... D20/43
8,646,627 B2 * 2/2014 Bass ..... A47F 5/0093 211/162
8,752,718 B2 * 6/2014 Stukenberg ..... A47G 25/0664 211/87.01
8,789,712 B2 * 7/2014 Johnson ..... A47F 5/0025 211/71.01
8,827,089 B2 * 9/2014 Stukenberg ..... A47F 5/0815 211/103
8,979,296 B2 * 3/2015 Wiemer ..... A47F 5/103 362/125
9,032,682 B2 * 5/2015 Knoll ..... E04B 2/74 52/481.2
9,142,150 B2 * 9/2015 Logan ..... G09F 7/00
9,420,901 B2 * 8/2016 Sun ..... A47F 5/103
9,456,708 B2 * 10/2016 Theisen ..... A47F 5/0018
D778,640 S * 2/2017 Martell ..... D6/675
D778,648 S * 2/2017 Johnson ..... D6/705.7
9,578,961 B1 * 2/2017 Johnson ..... A47F 5/0043
9,596,950 B2 * 3/2017 Waalkes ..... A47F 7/02
9,684,483 B2 6/2017 Ekkaia et al.
9,807,993 B2 * 11/2017 Montoya ..... A47F 5/0823
9,978,295 B1 * 5/2018 Denby ..... G09F 15/0056
9,980,582 B1 * 5/2018 Levy ..... A47F 5/0823
10,010,173 B1 * 7/2018 Ricco ..... A47B 96/027
10,037,449 B1 * 7/2018 Hahn ..... G06K 7/0008
10,413,092 B2 * 9/2019 Winnard ..... A47F 7/0021
10,433,659 B1 * 10/2019 Pedersen ..... A47F 5/0018
10,448,755 B1 * 10/2019 McDowell ..... A47F 5/103
2002/0130231 A1 * 9/2002 Winnard ..... B25H 3/04 248/206.5
2003/0192843 A1 * 10/2003 Winig ..... A47B 96/067 211/87.01
2004/0135364 A1 * 7/2004 Dale ..... G09F 3/0288 283/81
2005/0258059 A1 * 11/2005 Joyce ..... B25H 3/003 206/378
2006/0017841 A1 * 1/2006 Farrell ..... G08B 13/19632 348/373
2006/0237605 A1 * 10/2006 Joyce ..... F16B 21/086 248/206.5
2007/0072443 A1 * 3/2007 Rohrbach ..... G06F 1/18 439/39
2007/0131631 A1 * 6/2007 Dewey ..... A47F 5/0815 211/59.1
2007/0170139 A1 * 7/2007 Clark ..... A47F 5/137 211/189
2007/0241071 A1 * 10/2007 Antonioni ..... A47F 5/0807 211/87.01
2008/0092782 A1 * 4/2008 Daniel ..... A47F 5/103 108/50.02
2008/0237159 A1 * 10/2008 Bray ..... A47F 5/0018 211/59.2
2009/0078663 A1 * 3/2009 Gajewski ..... A47F 5/0823 211/153
2010/0044326 A1 * 2/2010 Meyer-Hanover ..... A47F 5/0025 211/59.4
2010/0051769 A1 * 3/2010 Tyson ..... A47F 5/0807 248/220.31
2010/0175919 A1 * 7/2010 Ellis ..... F21S 8/033 174/481
2011/0006181 A1 * 1/2011 Johnston ..... A47F 5/0861 248/220.41
2011/0204009 A1 * 8/2011 Karan ..... A47F 3/001 211/59.2
2013/0176398 A1 * 7/2013 Bonner ..... H04N 13/204 348/46
2013/0199066 A1 * 8/2013 Clark ..... G09F 15/00 40/606.01
2014/0224875 A1 * 8/2014 Slesinger ..... G06Q 10/087 235/385
2014/0263116 A1 * 9/2014 Wojciechowski ..... A47F 5/0807 211/85.2
2014/0305889 A1 * 10/2014 Vogler ..... A47F 1/12 211/59.3
2014/0370730 A1 * 12/2014 Flynn ..... H01R 25/147 439/122
2015/0083744 A1 * 3/2015 Vogler ..... A47F 1/126 221/154
2015/0102001 A1 * 4/2015 Zobel ..... A47F 1/04 211/85.28
2015/0313378 A1 * 11/2015 Mason ..... F16M 13/022 248/205.2
2016/0128210 A1 * 5/2016 Lee ..... G06F 1/1626 248/206.5
2016/0344135 A1 * 11/2016 Bonner ..... A47F 5/0018

(56) References Cited

U.S. PATENT DOCUMENTS

| | | | | |
|---|---|---|---|---|
| 2017/0153010 | A1 | 6/2017 | Waalkes et al. | |
| 2018/0296007 | A1* | 10/2018 | Berglund | A47F 5/0838 |
| 2019/0387902 | A1* | 12/2019 | Peck | A47F 5/0838 |

FOREIGN PATENT DOCUMENTS

| | | | |
|---|---|---|---|
| WO | 2013152772 | A1 | 10/2013 |
| WO | 2013177569 | A1 | 11/2013 |
| WO | 2014070684 | A1 | 8/2014 |
| WO | 2015173217 | A1 | 11/2015 |
| WO | 2016036609 | A1 | 3/2016 |
| WO | 2016106124 | A1 | 6/2016 |

* cited by examiner

RECONFIGURABLE MAGNETIC DISPLAY FIXTURE AND SYSTEM

CROSS-REFERENCE TO RELATED APPLICATION

This application is a non-provisional application of and claims priority to U.S. Provisional Patent Application No. 62/786,103, filed Dec. 28, 2018, which is incorporated herein by reference.

BACKGROUND OF THE INVENTION

Retail stores attempt to appeal to consumers by creating attractive displays for merchandise being offered for sale. Displays are used to highlight specific merchandise, to magnify the visual impact of the merchandise, and to differentiate different parts of the retail store among other things. Retail displays including shelving, tables, racks, etc. are often reconfigurable to provide a retailer with flexibility in changing displays over time to accommodate different merchandise.

SUMMARY

One embodiment of the invention relates to a display fixture including a magnetic focal wall and an auxiliary support member. The magnetic focal wall includes a magnetic panel, which is substantially planar and produces a magnetic field, and a perforated panel, which is substantially planar and defining a plurality of perforations extending entirely through the perforated panel. The magnetic panel defines a front surface. The perforated panel is coupled with the magnetic panel such that the perforated panel extends in a substantially parallel plane with and in front of the magnetic panel. Portions of the front surface of the magnetic panel are positioned behind the plurality of perforations. The auxiliary support member is configured to support a product thereon away from the magnetic focal wall and includes a magnet on a rear side thereof sized to fit within any one of the plurality of perforations such that the magnet of the auxiliary member is magnetically coupled with the magnetic panel through one of the plurality of perforations and the auxiliary support member extends forwardly from the perforated panel supported solely by the magnetic focal wall. Other display fixtures, display units, retail displays and methods are also described herein.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the terms "about" or "substantially" apply to all numeric values or descriptive terms, respectively, and generally indicate a range of numbers or characteristics that one of skill in the art would consider equivalent to the recited values or terms, that is, having the same function or results.

This innovation provides a reconfigurable display system for displaying retail merchandise or the like. The display system includes a support wall and various merchandise support accessories that at least partially magnetically couple with the support wall. In one example, the support wall includes two substantially planar panels including a first or perforated panel having an array of holes extending through a thickness thereof and second or magnetic panel, which fits substantially parallel to and behind the perforated panels. Each of the merchandise support accessories includes a peg connector sized to fit snugly in one of the perforations and having a magnetic free end thereof for interacting with and magnetically coupling with the magnetic panel behind the perforation panel through a corresponding one of the holes of the perforation panel. An edge of the corresponding one of the holes provides additional support to the peg connector. Each merchandise support accessory is configured to support merchandise of a significant weight while still being readily removed from and repositioned on the support wall via different ones of the holes for reconfiguration the overall arrangement of the display system. In one example, the support wall is configured to be removably coupled with and extends between two slotted vertical supports, such as those common in retail displays. These and other embodiments are further described below.

Figure 1:
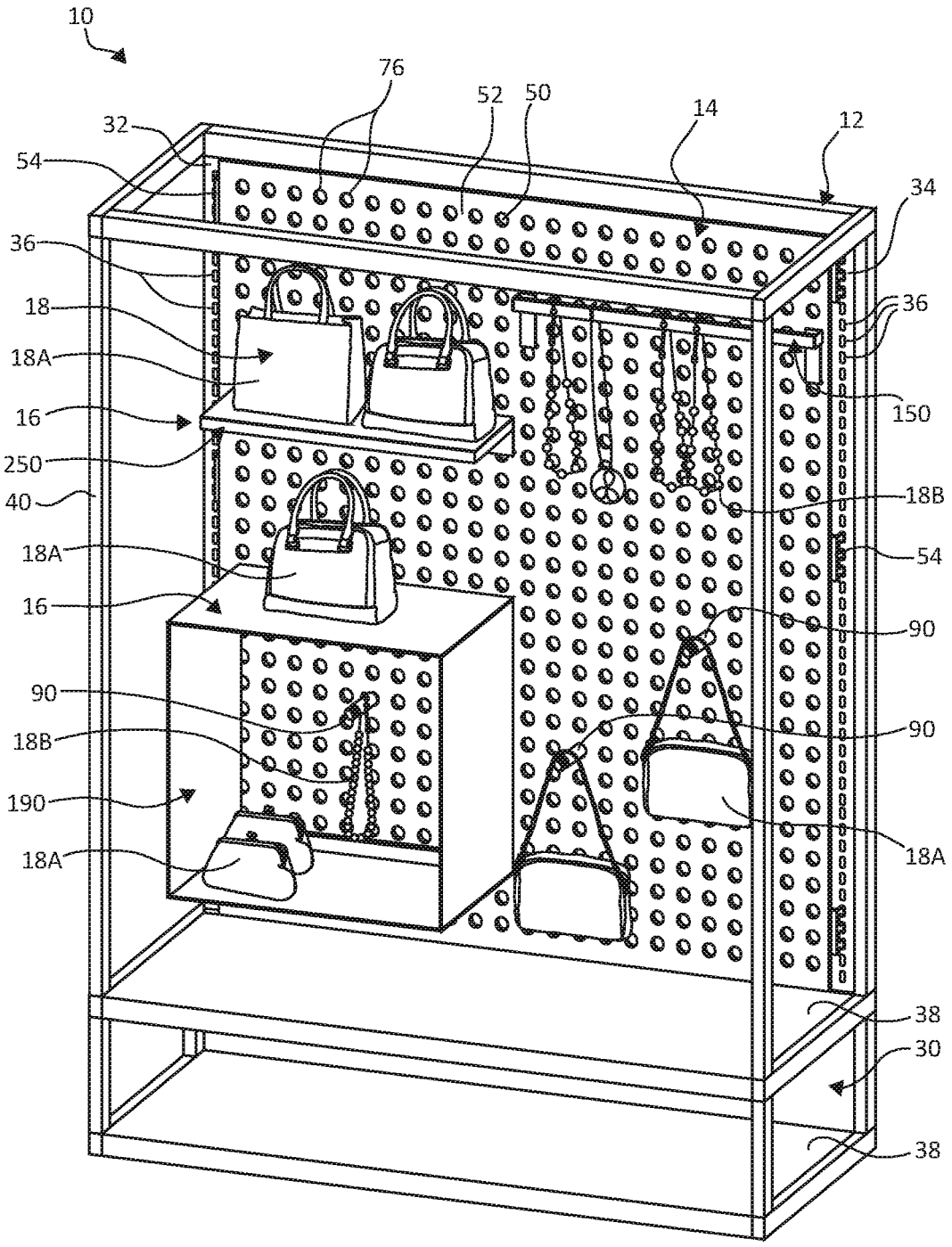
FIG. 1 is a front perspective view illustration of a retail display in a first configuration, according to one embodiment of the present invention.

Turning to the Figures, FIG. 1 illustrates a retail display 10, for example, in a retail store setting, including a magnetic display system 11 supporting a plurality of products 18, such as merchandise being offered for sale, marketing items, display objects, etc. In one embodiment, magnetic display system 11 includes a frame 12, a magnetic focal wall 14, and one or more auxiliary support members 16 for selectively maintaining one or more of the plurality of products 18, such as handbags 18A and/or jewelry, namely necklaces 18B in the illustration of FIG. 1. Auxiliary support members 16 are selectively received by and at least partially magnetically coupled to magnetic focal wall 14. In one example, the one or more auxiliary support members 16 are reconfigurable on magnetic focal wall 14 to provide a plethora of different configurations allowing the overall visual presentation of products 18 on magnetic display system 11 to be changed over time, continuing to create interest and marketing impact to the retail store setting in a non-stagnant manner.

Frame 12 is an optional component of magnetic display system 11, and in one embodiment is eliminated from magnetic display system 11. When included, frame 12 provides structure for supporting magnetic focal wall 14 and/or additional structural and/or aesthetic components. Frame 12 may be free standing and/or tied into one or more other structures (not shown) for support. In the embodiment illustrated in FIG. 1, for example, frame 12 includes a base 30 and vertically extending supports 32 and/or 34. Base 30 provides the footprint of frame 12 and sits adjacent a supporting surface (not shown). In one example, base 30 includes one or more shelves 38 for supporting merchandise being offered for sale or other items enhancing the retails store setting.

Vertically extending supports 32 and 34 extend upwardly from base 30 near a rear portion of the base 30, in one example, to provide structure for receiving magnetic focal wall 14. Each of vertically extending supports 32 and 34 are substantially identical, in one embodiment, and spaced apart from one another. Each of vertically extending supports 321 and 34 are configured to selectively couple with magnetic focal wall 14, in one example, via a substantially vertically linear array of slots 36 extending along a front side thereof.

In one embodiment, frame 12 includes surrounding frame members 40 extending forwardly (as illustrated), rearwardly, upwardly, downwardly, or to the sides of vertically extending supports 32 and 34. In one example, frame members 40 are provided as a largely aesthetic feature and/or to support additional magnetic display system 11 structure above magnetic focal wall 14. In one example, surrounding frame members 40 extend in front of vertically extending supports 32 and 34, while in another example, surrounding frame members 40 are eliminated.

Figure 2:
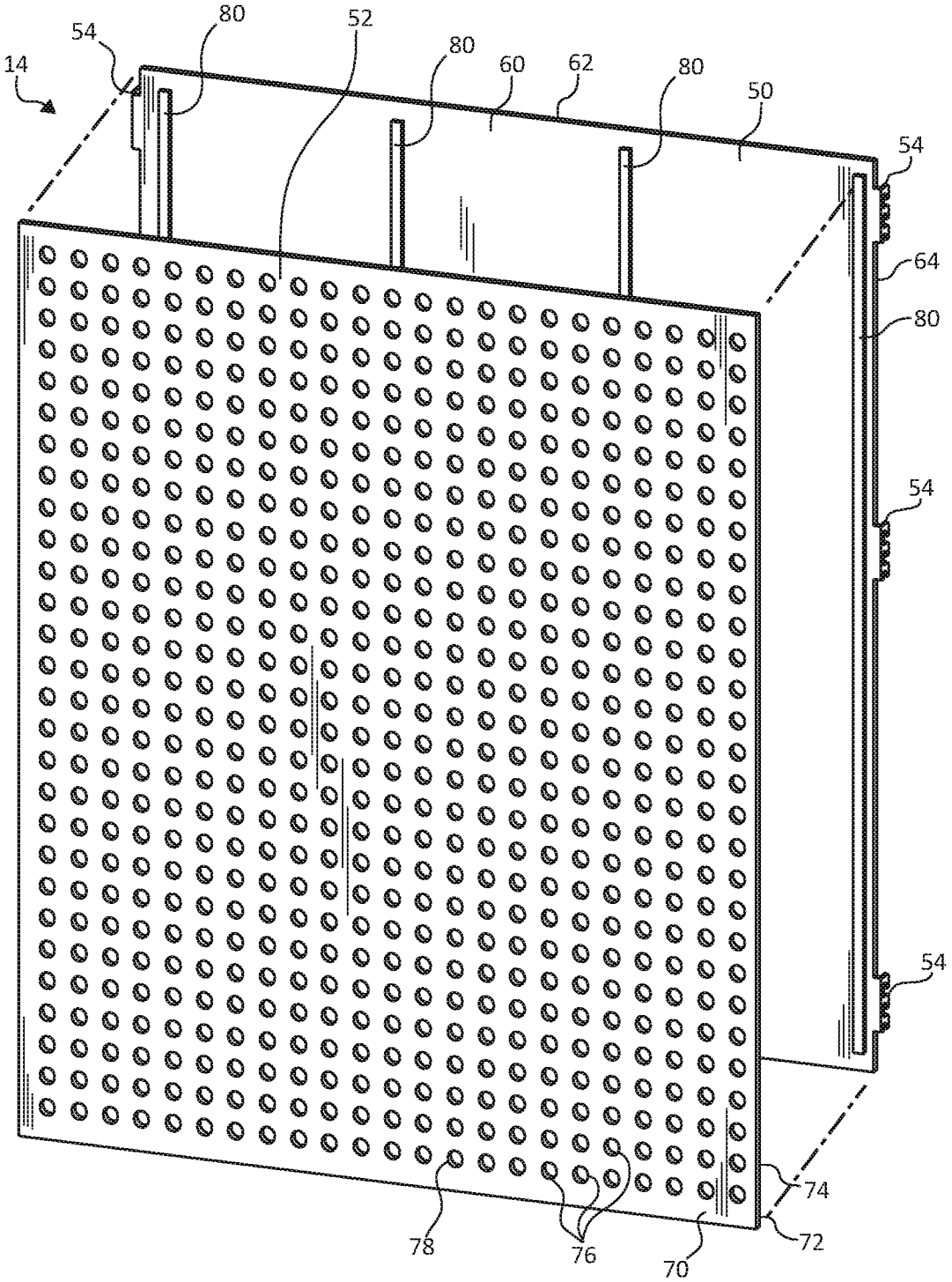
FIG. 2 is a front perspective view illustration of a back support of the retail display of FIG. 1, according to one embodiment of the present invention.

FIG. 2 illustrated an exploded perspective view of magnetic focal wall 14, according to one embodiment, including a magnetic panel 50, a perforated panel 52, and one or more support coupling members 54. In one example, magnetic focal wall 14 is substantially planar defining a front surface 60, a rear surface 62 opposite front surface 60, and a perimeter edge 64 extending between and around front surface 60 and rear surface 62. Magnetic panel 50 is formed of heavy-duty steel, or other material product a magnetic field, coated with a chip and scratch resistant finish, for example, with a color powder coat. However, other planar metallic boards are also contemplated provided they are of sufficient strength to maintain coupling with auxiliary support members 16 even when they are bearing products 18 (see FIG. 1), as will be further described below.

Figure 4:
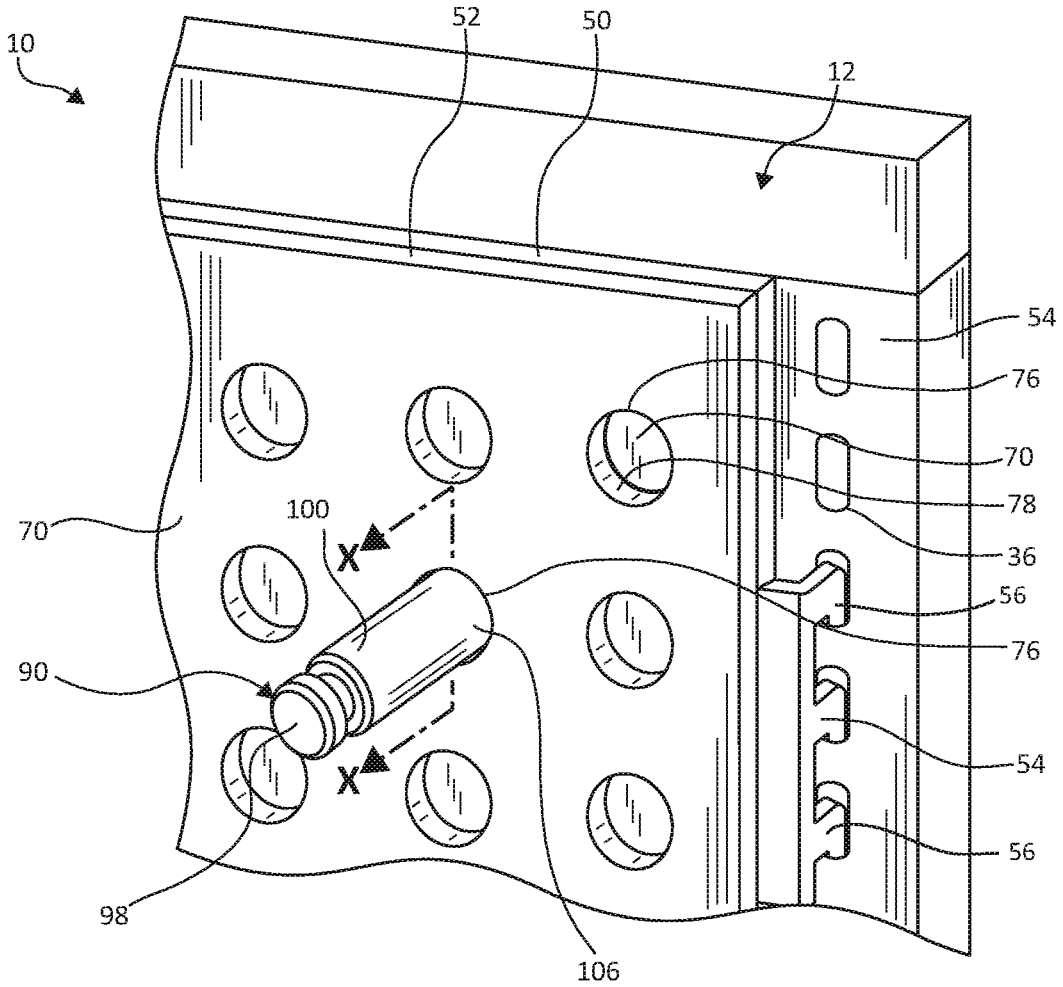
FIG. 4 is a detail view illustration of a portion of a retail display, according to one embodiment of the present invention.

In one example, magnetic panel 50 is formed integrally include and/or be coupled with to include supporting coupling members 54. Supporting coupling members 54 are configured to facilitate coupling magnetic focal wall 14 with frame 12. In one embodiment, a number of supporting coupling members 54 are placed along each of opposing edges of perimeter edge 64 and include rearward facing hooks 56 (see FIG. 4). Each hook 56 is configured to be securely received within one elongated slot of the array of elongated slots 36, as will be apparent to those of skill in the art reading the current application. In another embodiment, support coupling members 54 are included on perforated panel 52 in addition to or as an alternative to magnetic panel 50.

Perforated panel 52 is also substantially planar defining a defining a front surface 70, a rear surface 72 opposite front surface 70, and a perforation perimeter edge 78 extending between and around front surface 70 and rear surface 72. An array of perforations 76 is defined through perforated panel 52 with each of the perforations 76 extending from the front surface 70 to the rear surface 72 as a through-hole. Each perforation in the array of perforations 76 is sized in shaped in any suitable manner corresponding with shapes of the auxiliary support members 16, as will be further described below. In one example, each perforation in the array of perforations 76 is circular, square, rectangular, oval, triangular, or of another suitable shape. Each perforation is formed by perforation perimeter edge 78 around a perimeter of each perforation in the array of perforations 76. In one example, the array of perforations 76 is a rectangular array of linear rows and columns evenly spaced across perforated panel 52; however, otherwise sized, shaped, and configured arrays are also contemplated. Perforated panel 52 is formed of any suitable substantially strong, and in one example, substantially rigid, material to maintain the original shape of each perforation in the array of perforations 76 even after repeated interaction with auxiliary support members 16, as will be further described below. In one example, perforated panel 52 is a formed of sheet metal, polycarbonate, acrylic, other suitable plastic, plywood, or other suitable planar material.

Figure 5:
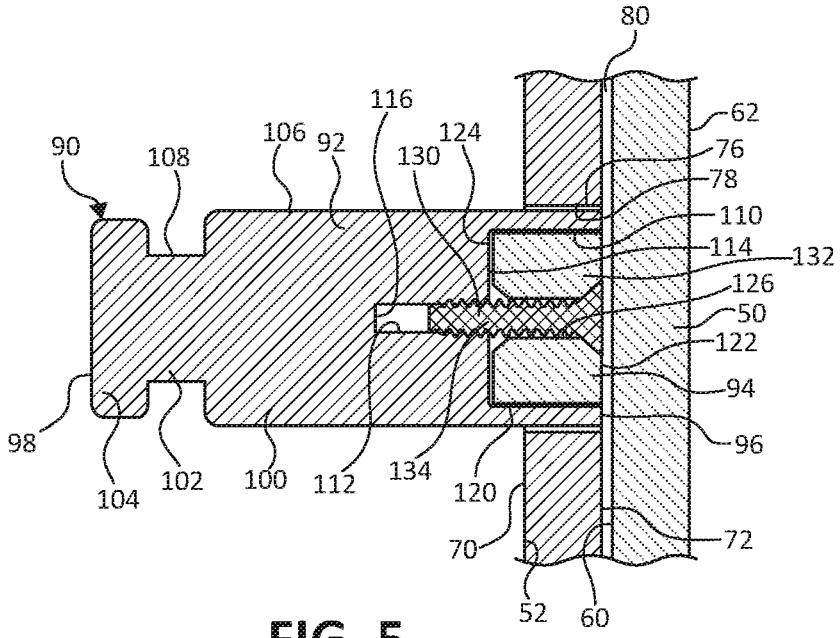
FIG. 5 is a cross-sectional view illustration taken along line X-X of FIG. 4, according to one embodiment of the present invention.
Figure 6:
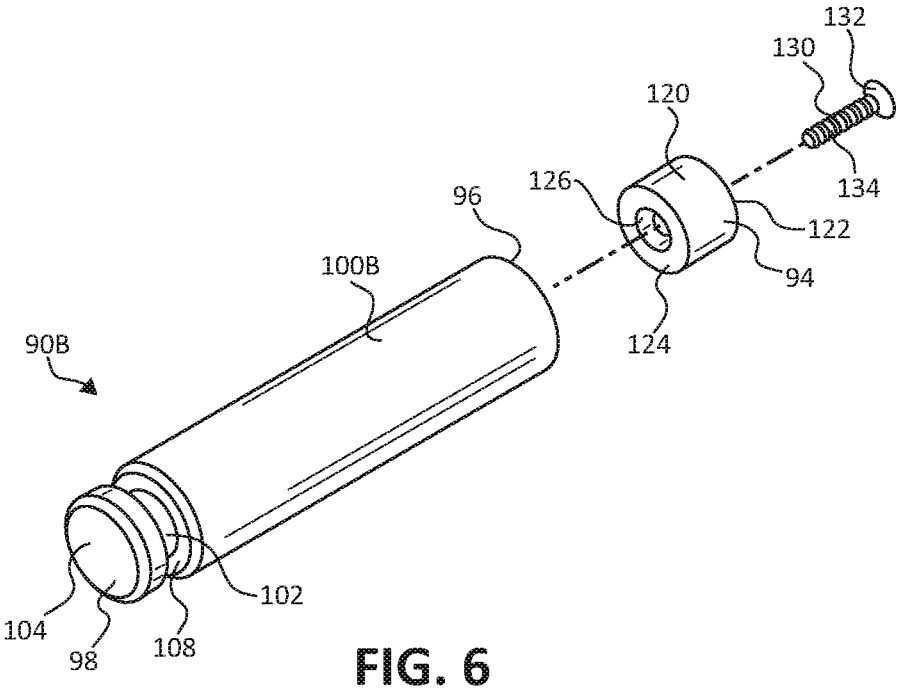
FIG. 6 is an exploded, front perspective view illustration of a support puck of the retail display of FIG. 1, according to one embodiment of the present invention.

Magnetic focal wall 14 is assembled, in one embodiment, by securing perforated panel 52 to magnetic panel 50. More specifically, in the illustrated embodiment, coupling means are applied to front surface 60 of magnetic panel 50 and a rear surface 72 of perforated panel 52 is secured thereto. In one example, coupling means are provided in the form of adhesive strips 80, more particularly, foam tape. The foam tape adhesive strips 80 provide a small amount of additional spacing between magnetic panel 50 and perforated panel 52 as shown in FIG. 5, for example. In one example, foam tape adhesive strips 80 are of sufficient adhesiveness to permanently secure magnetic panel 50 to perforated panel 52. In one example, upon assembly, magnetic panel 50 and perforated panel 52 are positioned in substantially parallel planes.

Once magnetic focal wall 14 is assembled, it is positioned within retail store setting, for example, it is coupled with a support structure, such as frame 12. More specifically, in one embedment, magnetic focal wall 14 is hung from frame 12 by placing each hook 56 of each supporting coupling member 54 into corresponding elongated slots of the array of elongated slots 36 in a corresponding one of vertically extending supports 32 and 34. To suspend magnetic focal wall 14 between vertically extending support 32 and vertically extending support 34.

Once again referring to FIG. 1, auxiliary support members 16 each take on any one of a variety of suitable forms, as will be apparent to those of skill in the art upon reading this application, such as a peg 90, a peg 90B, a support bar bracket 150, closed shelf 190, and open shelf 250, and each being configured to be selectively and magnetically coupled with magnetic focal wall 14 through a perforation in the array of perforations 76.

Figure 3:
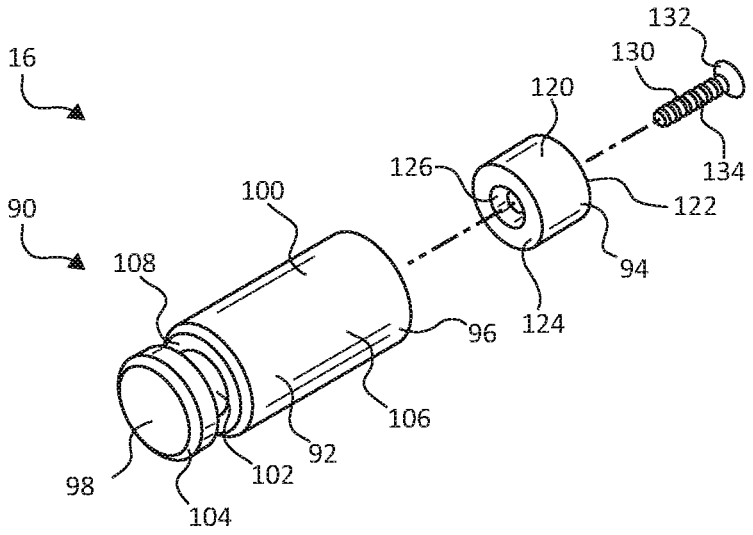
FIG. 3 is an exploded, front perspective view illustration of a support puck of the retail display of FIG. 1, according to one embodiment of the present invention.

More specifically, FIG. 3 illustrates an exploded, perspective view of peg 90 including a primary body 92 and a magnet 94. Peg 90 includes a rear end 96 and a front end 98 opposite the rear end 96. Primary body 92 is elongated to extend from rear end 96 toward and in one example, to front end 98. Primary body 92 includes an elongated segment, such as a cylinder 100 in the illustrated embodiments, a neck 102, and an end cap 104. Elongated segment is shaped and sized to have a cross-section substantially identical, but slightly smaller than, a shape of one perforation of the array of perforations 76, as illustrated for one embodiment with additional reference to FIGS. 4 and 5. For instance, in one example, elongated segment is a cylinder 100 where each of the array of perforations 76 are circular having an outside surface 106.

Neck 102 extends from a frontmost end of cylinder 100 forward toward front end 98. Neck 102 extends from cylinder 100 with a cross-sectional size that is smaller than cylinder 100 forward to end cap 104. End cap 104 is sized and shaped to be larger than neck 102, for example, to have a similar shape and size closer to that of cylinder 100 than neck 102. Primary body 92 defines a circumferential groove 108 about neck 102 between cylinder 100 and end cap 104. In one example, circumferential groove 108 is configured to receive a portion of a product 18 (see FIG. 1) to be hung therefrom, for example, a portion of a necklace, a strap of a handbag or other bag, or a hook of a hanger (not shown). End cap 104 is configured to generally prevent inadvertent movement of a corresponding product 18, e.g., such as sliding, off of peg 90.

In one example, cylinder 100 defines a primary cavity 110 and a secondary cavity 112 as best illustrated with reference to the cross-sectional illustration of FIG. 5. Primary cavity 110 extends from rear end 96 of primary body 92 toward, but not to front end 98 to form a front end 114 of primary cavity 110. Primary cavity 110 is sized and shaped to receive magnet 94. Secondary cavity 112 is generally smaller than primary cavity 110 and extends from front end 116 of secondary cavity 112 further toward front end 98 to define a front end 116 of secondary cavity 112. Secondary cavity 112 is sized and shaped, and in one embodiment, threaded, to receive a screw 130 or other suitable coupling member.

Referring to FIGS. 2 and 5, magnet 94 is of significant strength and attraction to magnetic panel 50 to form a secure and strong coupling allowing peg 90 to support one or more products 18 without inadvertent release of peg 90, more particularly, magnet 94 thereof, from magnetic panel 50. In one example, magnet 94 is a neodymium magnet or other suitable magnet. In one embodiment, magnet 94 is sized and shaped as a hollow cylinder or other hollow, elongated prism. Magnet 94 defines an outside surface 120, a rear end 122, a front end 124 opposite rear end 122, and a center cavity 126. In one example, outside surface 120 of magnet 94 is sized and shaped similar to primary cavity 110 such that magnet 94 fits within primary cavity 110. Length of magnet 94 from front end 124 to rear end 122 may vary, and, in one embodiment, is sized such that rear end 122 is positioned substantially co-planarly with rear end 96, as illustrated, for example, in FIG. 5, and/or to extend slightly rearwardly form rear end 96.

In one example, center cavity 126 of magnet 94 is substantially sized and shaped similarly to second cavity 112 of primary body 92, and in one embodiment is threaded, for instance, threaded similarly to second cavity 112. In one example, center cavity 126 is elongated immediately adjacent rear end 122. Peg 90 is assembled by placing magnet 94 within primary cavity 110, such that front end 124 of magnet 94 faces and, in one example, contacts, front end 114 of primary cavity 110. In this position, center cavity 126 of magnet 94 is aligned with and coaxially extends relative to secondary cavity 112 of cylinder 100. A screw 130 or other suitable coupling means is thread through rear end 122 of center cavity 126 and into secondary cavity 112 of cylinder 100 to secure magnet 94 to cylinder 100 as shown in FIG. 5. More specifically, a screw 130 with a head 132 and a threaded shank 134, is positioned such that threaded shank 134 is collectively maintained with in secondary cavity 112 and center cavity 126 with head 132 being countersunk within an end of center cavity adjacent rear end 122 of magnet 94.

During use of peg 90 with magnetic display system 11, for example, as shown in FIG. 1, a rear end 96 of peg 90 is moved through front surface 70 of perforated panel 52 via one perforation of the array of perforations 76 and into contact with front surface 60 of magnetic panel 50. Notably, while a gap is formed between n rear end 122 of magnet 94 and front surface 60 of magnetic panel 50 for illustration, in practice, in one embodiment, rear end 122 of magnet 94 directly contacts front surface 60 of magnetic panel 50. Magnet 94 is polarized to be magnetically secured to front surface 60 of magnetic panel 50. In addition to coupling via magnetization, in one embodiment, outside surface 106 of peg 90 also rests on a bottom portion of perforation perimeter edge 78 of the corresponding perforation 76 providing additional vertical support to peg 90 by magnetic focal wall 14 and, in some instances, allowing additional capacity for weight of supported products 18 hung thereon.

While magnet 94 is sufficient to maintain peg 90 and/or any product 18 thereon relative to magnetic focal wall 14, the magnetic pull between magnet 94 and magnetic panel 50 is generally overcome via hand force by a common retail store worker, such that peg 90 can be relatively easily pulled from one perforation 76. Peg 90 can then be repositioned in another one of perforations 76 and/or stored for future use as desired for a particular configuration of magnetic display system 11. The ability for reconfiguration of pegs 90 relative to magnetic focal wall 14 provides magnetic display system 11 in a manner allowing for many reconfigurations and visual impressions to be provided by a single magnetic display system 11 over time.

FIG. 5 illustrates a peg 90B that is substantially identical to peg 90 as indicated by like reference numerals as compared to FIG. 3. Peg 90B only differs from peg 90 in that a cylinder 100B of peg 90B is longer than cylinder 100 of peg 90. In this manner, use of differing pegs 90 and 90B provides additional depth and interest to magnetic display system 11 with products 18 being supported at different distances in front of font surface 70 of perforated panel 52.

Figure 7:
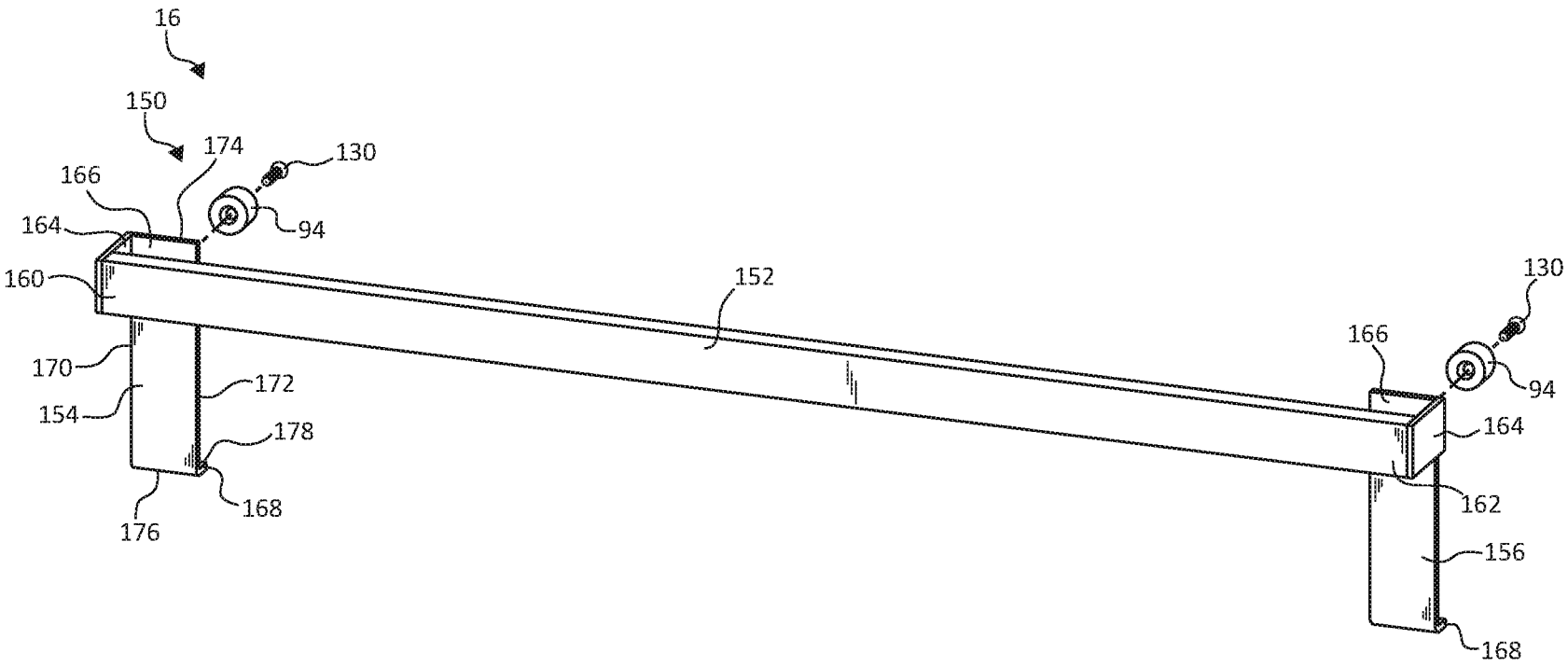
FIG. 7 is a front perspective view illustration of a display bar of the retail display of FIG. 1, according to one embodiment of the present invention.

The reconfigurability of magnetic display frame 11 is increased by providing various types of auxiliary support members 16, for example, as illustrated in FIG. 1. FIG. 7, for example, illustrates one embodiment of support bar bracket 150 configured for use with magnetic display system 11, as shown in FIG. 1. Support bar bracket 150 includes a cross bar 152, a first mount 154, and a second mount 156, which, in one example, are each formed of a suitable material, such as aluminum, polycarbonate, etc. Cross bar 152 is elongated and configured to support various products 18 thereon. In this manner, cross bar 152 has any suitable cross section, such a circular, rectangular, triangular, etc. and defines a first end 160 and a second end 162 opposite first end 160. Cross bar 152 extends between, and in one embodiment, connects first mount 154 to second mount 156. For example, first end 160 of cross bar 152 is coupled to first mount 154 and second end 162 of cross bar 152 is coupled to second mount 154.

In one example, first mount 154 couples cross bar 152 to magnets 94, which are sized, shaped, and configured to be received within any one of the array of perforations 76 similarly to magnets 94 of peg 90 above. In one embodiment, first mount 154 includes an end segment 164, a back segment 166, and an offset segment 168. End segment 164 extends rearwardly from first end 160 to back segment 166. In one example, end segment 164 is a plate that spaces cross bar 152 from magnetic focal wall 14. Back segment 166 extends substantially vertically downwardly from end segment 164 in a plate-like configuration defining a first side edge 170, a second side edge 172 opposite first side edge 170, a top edge 174 extending between first side edge 170 and a second side edge 172, a bottom edge 176 opposite top edge 175 and extending between first side edge 170 and a second side edge 172, and back surface 182.

Back surface 182 is substantially planar and faces away from cross bar 152 while extending between first side edge 170, second side edge 172, top edge 174, and bottom edge 176. Magnet 94, which is substantially similar to magnet 94 of peg 90, is coupled to back segment 166 via screw 130 or other coupling means, for instance through an aperture 180 formed through a top portion of back segment 166. In one example, magnet 94 of support bar bracket 150 is slightly larger in diameter than magnet 94 of peg 90, to more fully fill a perforation 76 since magnet 94 of support bar bracket 150 is not encased in another body such as cylinder 100 of peg 90 (see FIGS. 3 and 5).

Figure 9:
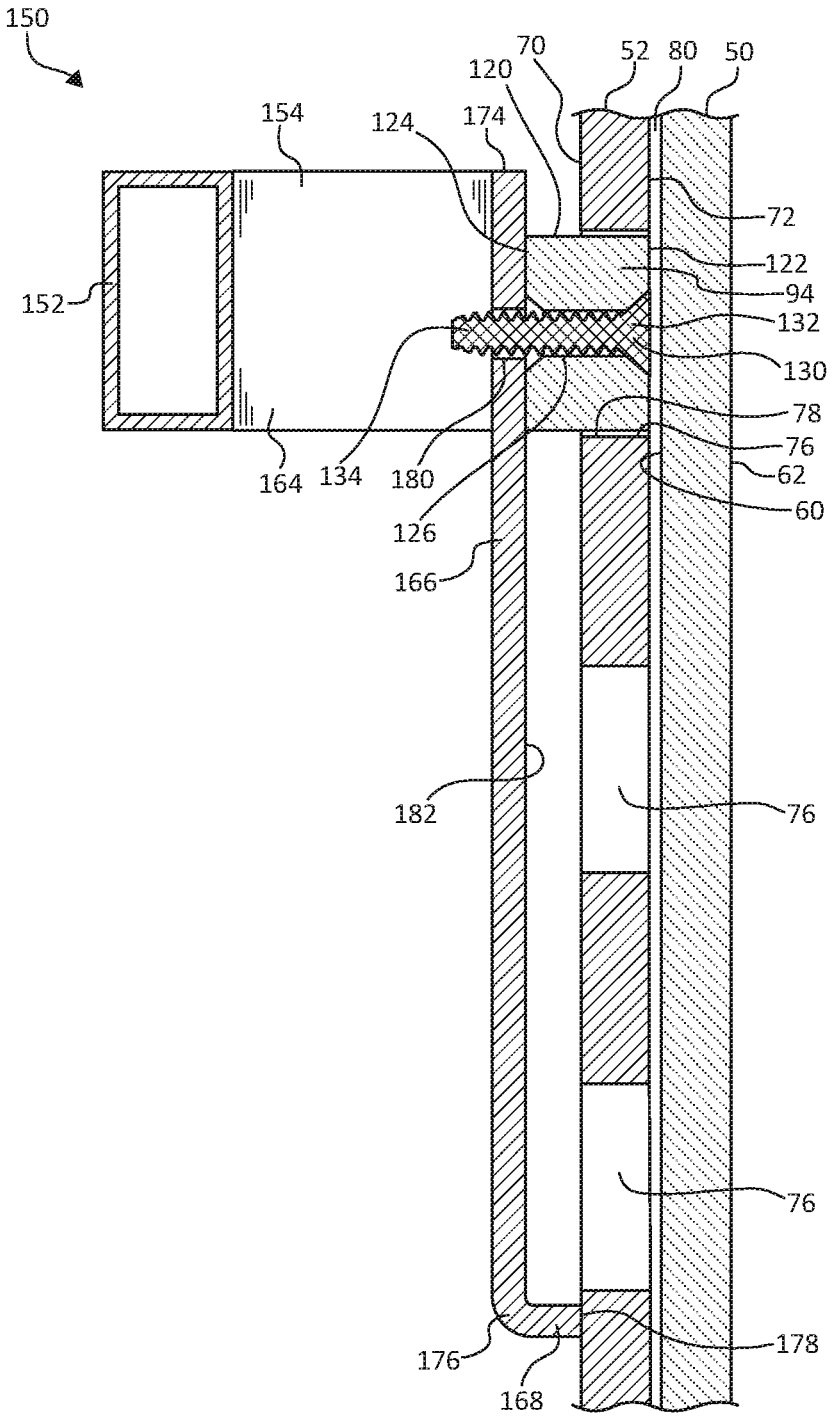
FIG. 9 is a cross-sectional view illustration taken along line XI-XI of FIG. 8, according to one embodiment of the present invention.

Offset segment 168 extends from bottom edge 176 rearwardly a smaller distance than a length of magnet 94 to a back or free edge 178. Offset segment 168, in one embodiment, is configured to provide an offset between front surface 70 of perforated panel 52 and back surface 182 of back segment 166 to compliment the offset between front surface 60 of magnetic panel 50 and back surface 182 caused by a length of magnet 94 during use (see, e.g., FIG. 9) such that when coupled with magnetic focal wall 14, back segment 166 extends substantially vertically. In addition, offset segment 168 generally decreases any undesired rotation or tilt of support bar bracket 150 about magnets 94. Second mount 156 is substantially a mirror image of first mount 154 formed at second end 162 of cross bar 152.

Figure 8:
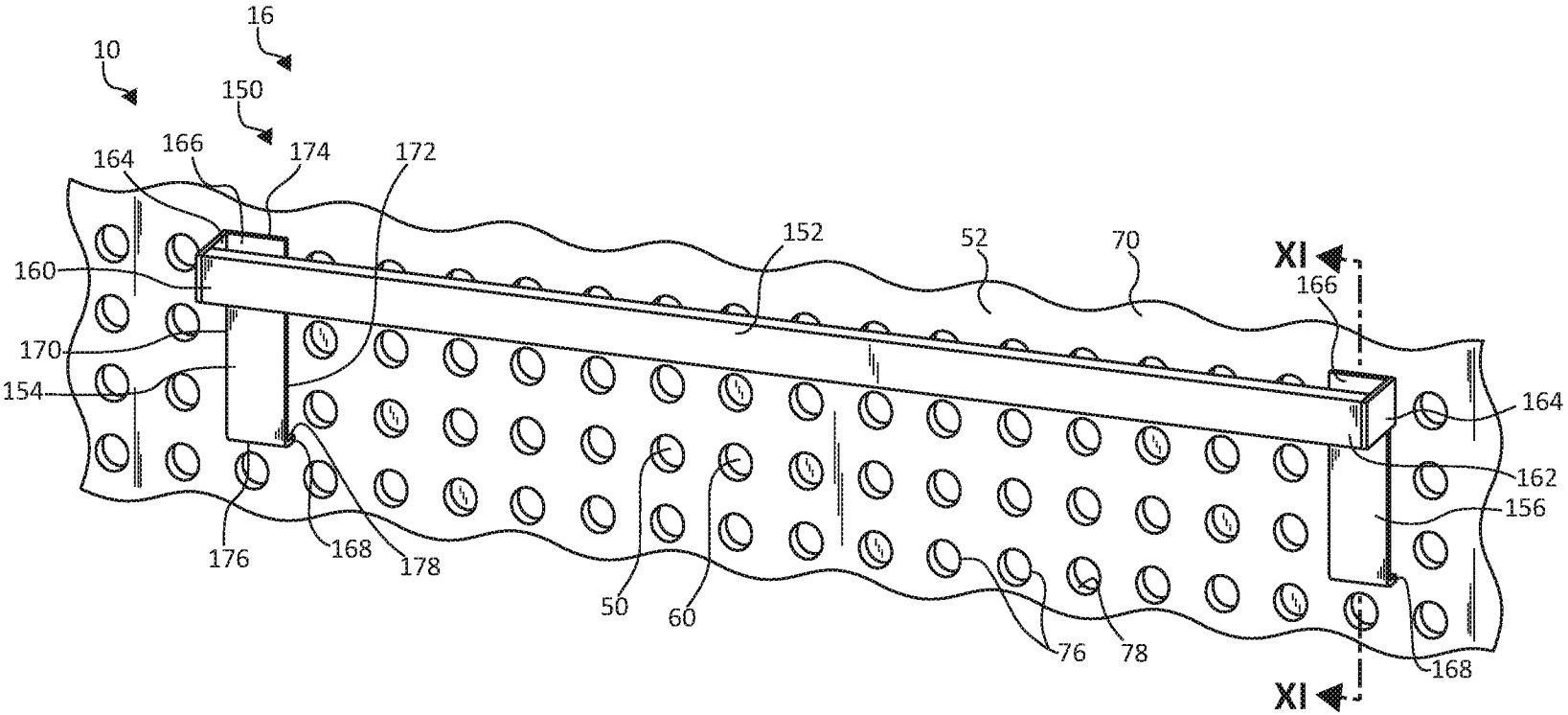
FIG. 8 is a front perspective view illustration of a portion of the retail display of FIG. 1 including the display bar of FIG. 7, according to one embodiment of the present invention.

Support bar bracket 150 is coupled to magnetic focal wall 14 by aligning and then moving each of the two magnets 94, one on first mount 154 and one on second mount 156 with two spaced apart perforations 76. Referring to FIG. 8 and the corresponding cross-section of FIG. 9 taken about the line XI-XI, when each of magnets 94 is positioned in one of perforations 76, where each of those perforations 76 are in the same linear row of the array accordingly to one embodiment, free edge 176 of offset segment 168 contacts front surface 70 of perforated panel 52 in a manner preventing or at least decreasing undesired tilting or rotating of cross bar 152 and all of support bar bracket relative to magnets 94. Since support bar bracket 150, like peg 90, uses the magnetic force between magnets 94 and magnetic focal wall 14 to and the vertical force of perforation perimeter edge 78 against magnet 94, support bar bracket 150, like peg 90 is readily reconfigurable. Magnet 94 once again is of sufficient strength to maintain support bar bracket 150 coupled to magnetic focal wall 14 when supporting one or more products 18, but to allow a user pulling on support bar bracket 150 to readily remove support bar bracket 150 without the use of tools.

Figure 10:
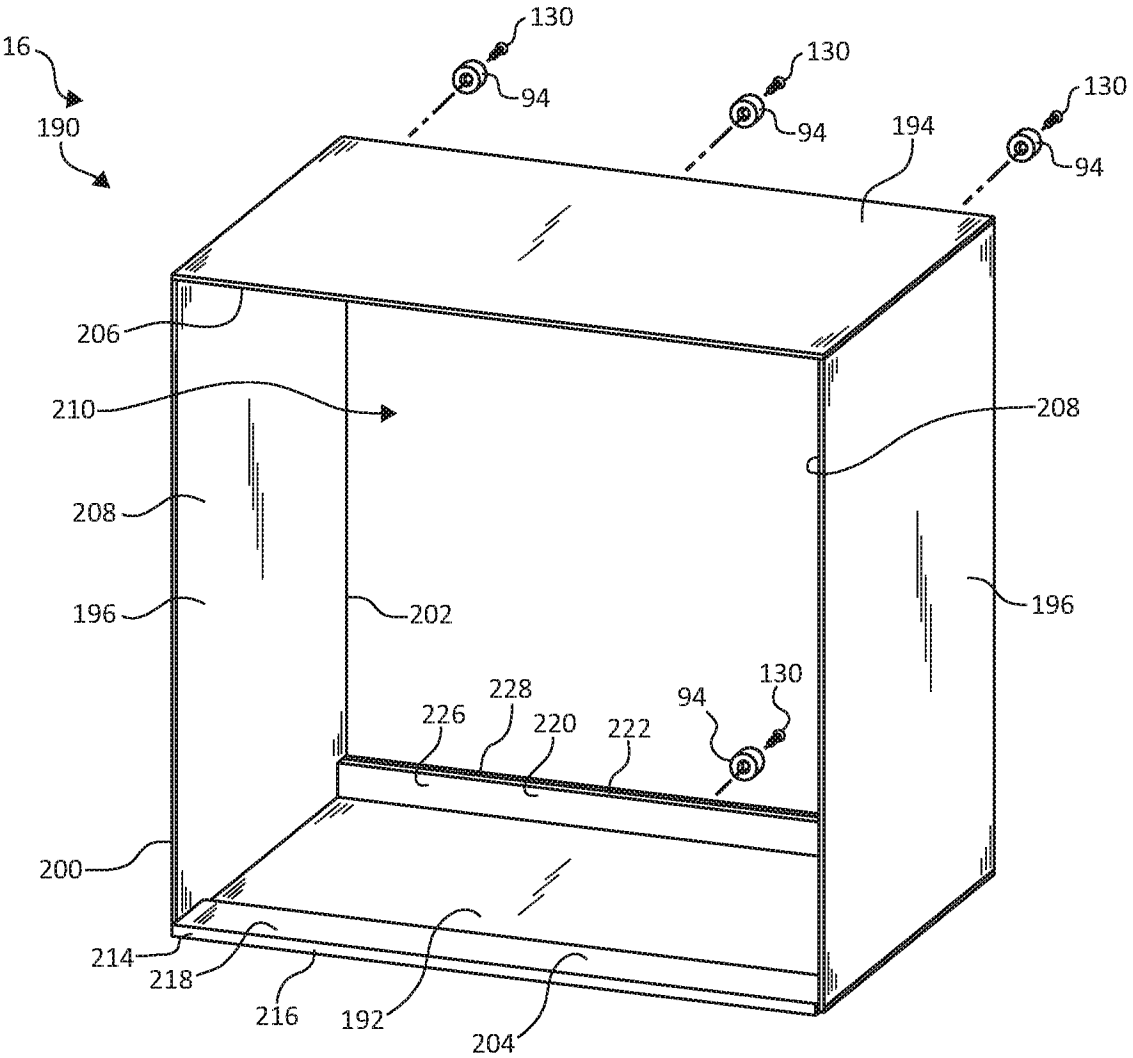
FIG. 10 is a front perspective view illustration of a display box of the retail display of FIG. 1, according to one embodiment of the present invention.

FIG. 10, for example, illustrates one embodiment of closed shelf 190 configured for use with magnetic display system 11, as shown in FIG. 1. Closed shelf 190 includes a bottom wall 192, a top wall 194 opposite bottom wall 192, and sidewalls 196 each extending between bottom wall 192 and top wall 194 opposite one another. In one example, each of bottom wall 192, top wall 194, and sidewalls 196 is formed of a substantially planar member, such as aluminum, polycarbonate, etc. In one example, each of bottom wall 192, top wall 194, and sidewalls 196 is joined edge to edge to two other adjacent ones of bottom wall 192, top wall 194, and sidewalls 196 opposite one another to form a box. In other examples, one or more of bottom wall 192, top wall 194, and sidewalls 196 are eliminated. Bottom wall 192, top wall 194, and sidewalls 196 collectively define a front edge 200, a rear edge 202 opposite front edge 200.

Figure 12:
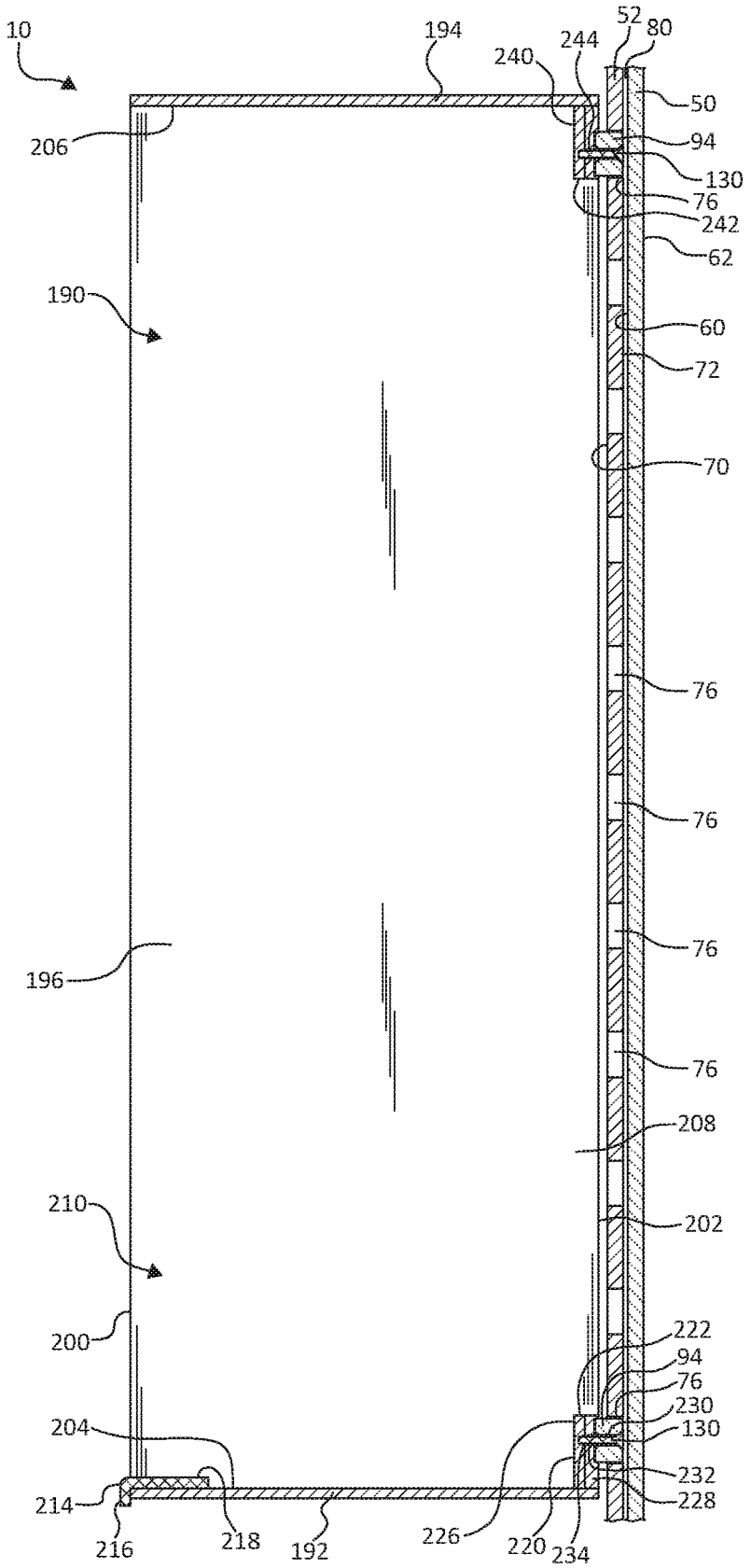
FIG. 12 is a cross-sectional view illustration taken along line XII-XII of FIG. 11, according to one embodiment of the present invention.

Bottom wall 192 defines an upwardly facing or inside surface 204, top wall 194 defines a downwardly facing or inside surface 206, and sidewalls 196 define inside surfaces 208, where inside surfaces 204, 206, and 208 collectively define a compartment 210 therebetween for supporting products 18 and/or other items. Additionally referring to the cross-sectional view of FIG. 12, in one example, bottom wall 192 additionally includes a front angle 214 secured to or near a portion of front edge 200 defined by bottom wall 192 to protect front edge 200 from products 18 being slid into and out of compartment 210 and/or to give closed shelf 190 added rigidity. In one embodiment, front angle 214 has a substantially L-shaped cross-section as shown in FIG. 12, defining a top segment 218 and a depending or front segment 216 extending substantially perpendicularly relative to top segment 218. Top segment 218 is coupled to inside surface 204 of bottom wall 192, such that front segment 216 hangs over and largely covers the portion of front edge 200 defined by bottom wall 192.

Figure 11:
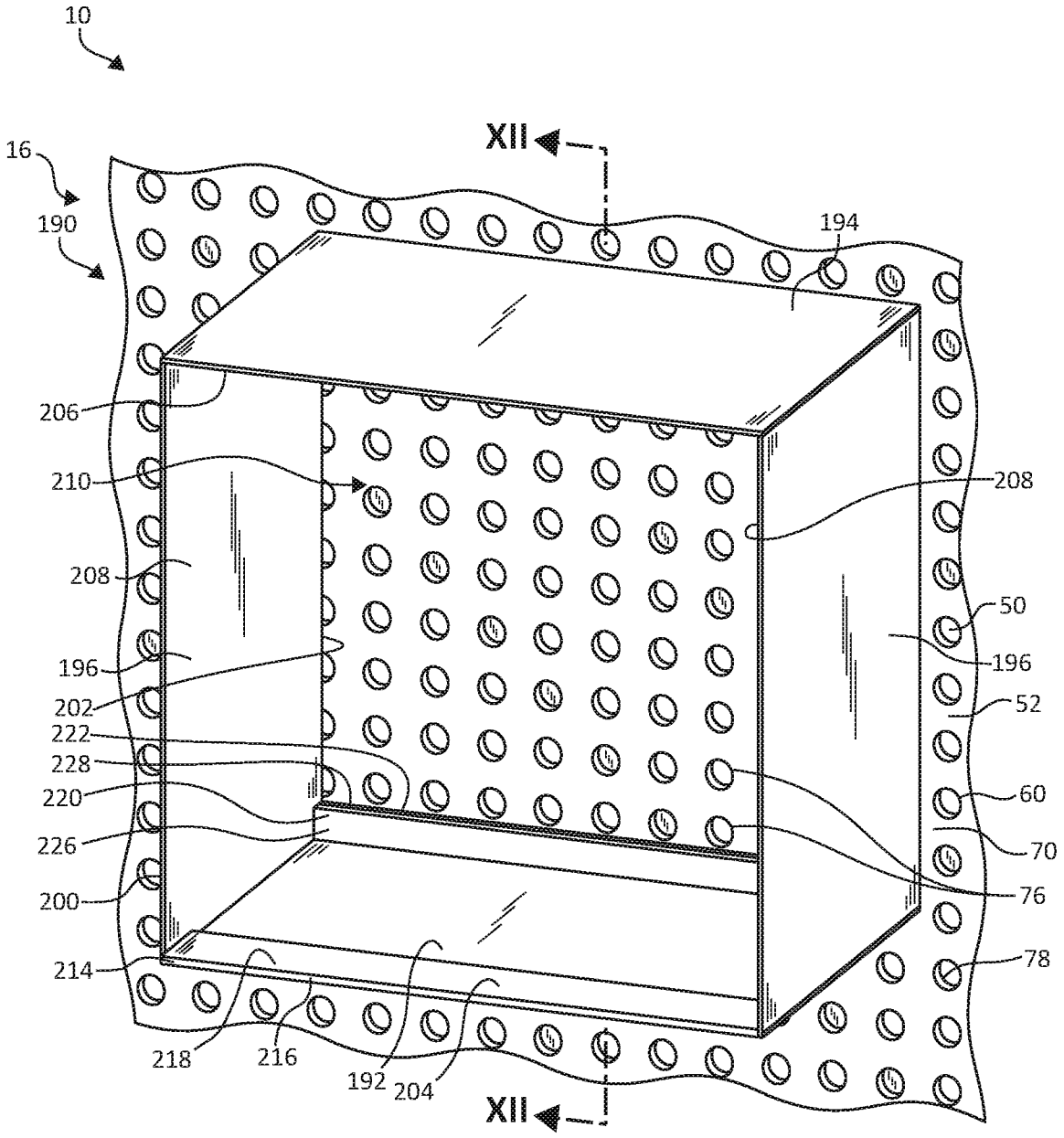
FIG. 11 is a front perspective view illustration of a portion of the retail display of FIG. 1 including the display box of FIG. 10, according to one embodiment of the present invention.

In one embodiment, closed shelf 190 includes a bottom flange 220 extending upwardly from a rear edge 202 portion defined by bottom wall 192 to a top free edge 222. Bottom flange 220 extends along a substantial entirety of a width of bottom wall 192 as measured between sidewalls 196, in one example. In one embodiment, bottom flange 220 is formed integrally with and folded up or molded to extend upwardly from bottom wall 192 while, in another embodiment, bottom flange 220 is formed separately from and coupled with bottom wall 192. In the illustrated embodiment, as best illustrated in FIGS. 10-12, bottom flange 220 includes a front plate 226 and a rear plate 228, which are substantially identically sized and shaped, but, in one example, have differing thickness. Front plate 226 and rear plate 228 are coupled primary surface to primary surface to collectively form bottom flange 220.

Bottom flange 220 defines a collective aperture 230 at each position along bottom flange 220 where a magnet 94 will be coupled. Collective aperture 230 is formed by an aperture 232 extending entirely through rear plate 228 and a cavity 234 extending from a rear surface of front plate 226 partially into front plate, in one example. Collective aperture 230 is threaded in one embodiment, to receive screw 130 as thread through magnet 94 to couple magnet 94 to bottom flange 220 in a similar manner as magnets are coupled to support bar bracket 150. In one example, two or more, for instance, three, magnets 94 are similarly attached to bottom flange 220 and are place along bottom flange 220 with a center-to-center spacing substantially identical to the center-to-center spacing of perforations 76 in a linear row of perforated panel 52.

In one embodiment, closed shelf 190 includes top flange 240 extends downwardly from top wall 194, more particularly, from a portion of rear edge 202 defined by top wall 194 to a bottom free edge 242 opposite top wall 194, and, in one example, is a substantially identical manner as bottom flange 220 extends upwardly from bottom wall 192. Top flange 210 defines collective aperture 244, similar to collective aperture 239 of bottom flange 220, configured to receive a screw 130 to secure a magnet 94 to top flange 240. In one example, two or more, for instance, three, magnets 94 are similarly attached to top flange 240 and are place along top flange 240 with a center-to-center spacing substantially identical to the center-to-center spacing of perforations 76 in a linear row of perforated panel 52. In one embodiment, magnets 94 coupled to top flange 240 are positioned in vertical alignment with magnets coupled to bottom flange 220.

Additionally referring to FIG. 11, closed shelf 190 is coupled to magnetic focal wall 14 by aligning each of the magnets 94 coupled to bottom flange 220 and top flange 240 with a different perforation 76 and sliding closed shelf 190 rearwardly through each such perforation 76 until each magnet 94 contacts and is magnetically engaged with magnetic panel 50. The multiple magnet 94 coupling of closed shelf 190 with magnetic focal wall 14 allows closed shelf 190 to support a higher total product weight and the two rows of magnets 94, that is via bottom flange 220 and top flange 240 generally decreases undesired tilting or rotating of closed shelf 190 relative to each magnet 94. Since closed shelf, like peg 90, uses the magnetic force between magnets 94 and magnetic focal wall 14 to and the vertical force of perforation edges 78 against magnets 94, closed shelf 190, like peg 90 is readily reconfigurable. Magnet 94 once again is of sufficient strength to maintain closed shelf 190 coupled to magnetic focal wall 14 when supporting one or more products 18, but to allow a user pulling on closed shelf to readily remove closed shelf without the use of tools.

Figure 13:
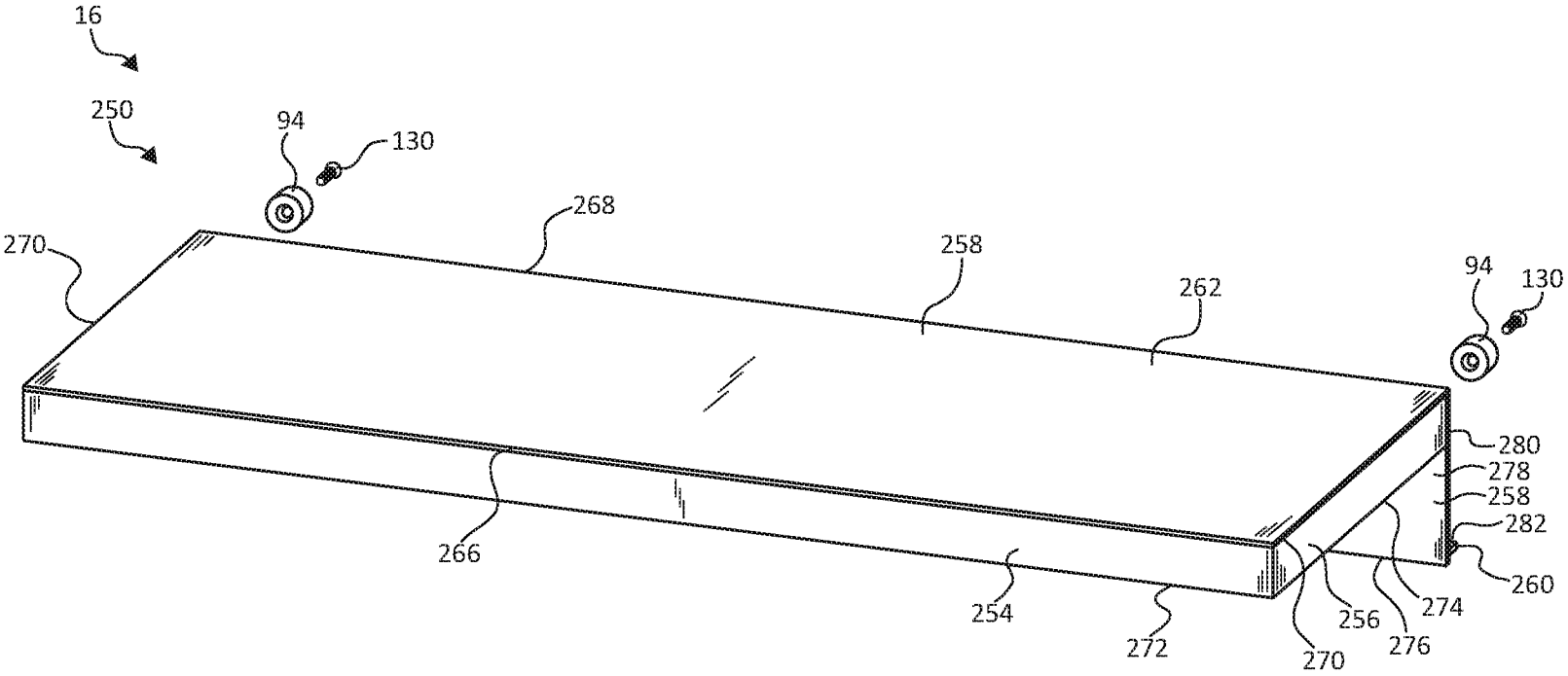
FIG. 13 is a front perspective view illustration of a display shelf of the retail display of FIG. 1, according to one embodiment of the present invention.
Figure 14:
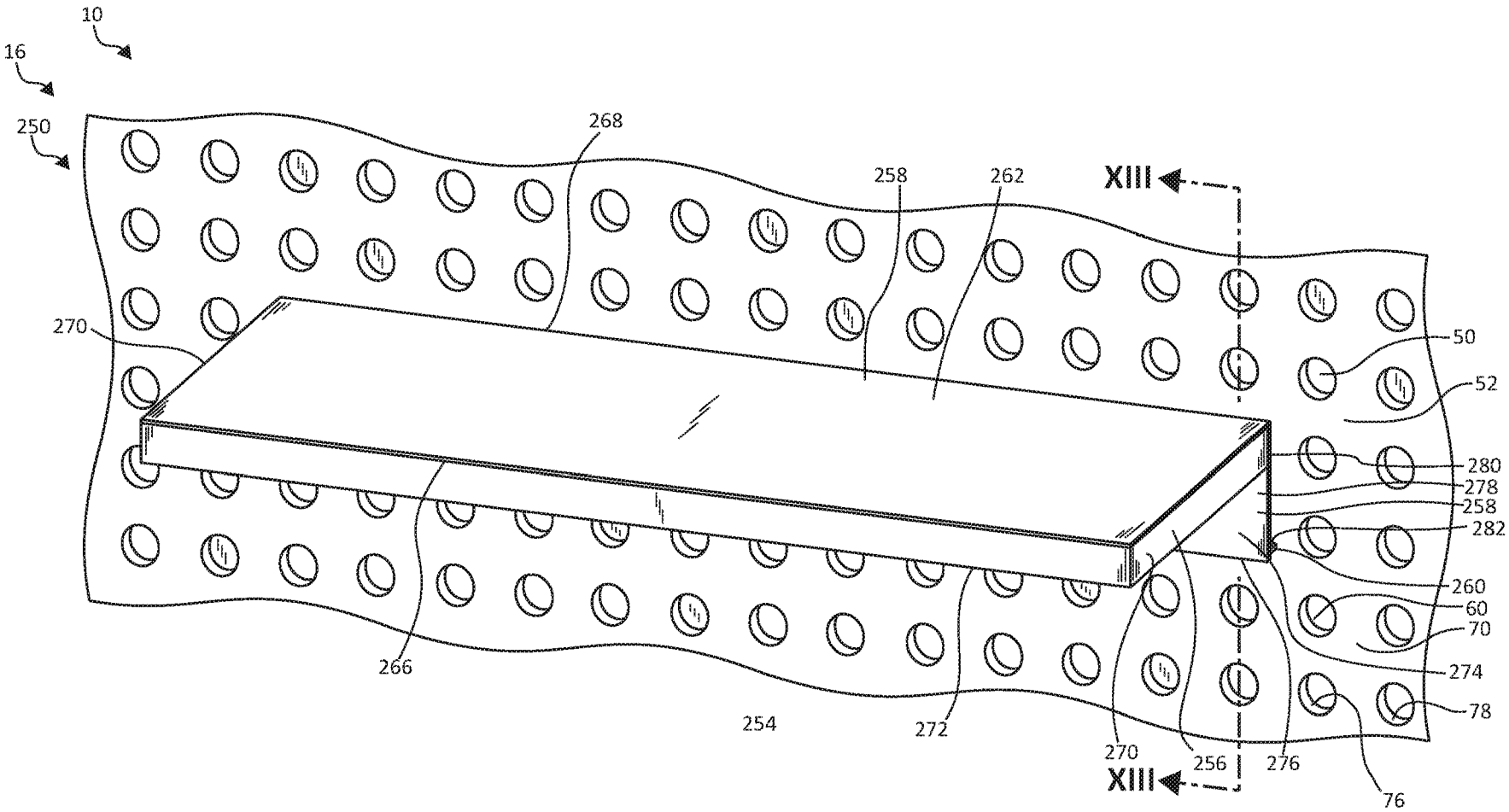
FIG. 14 is a front perspective view illustration of a portion of the retail display of FIG. 1 including the display shelf of FIG. 13, according to one embodiment of the present invention.
Figure 15:
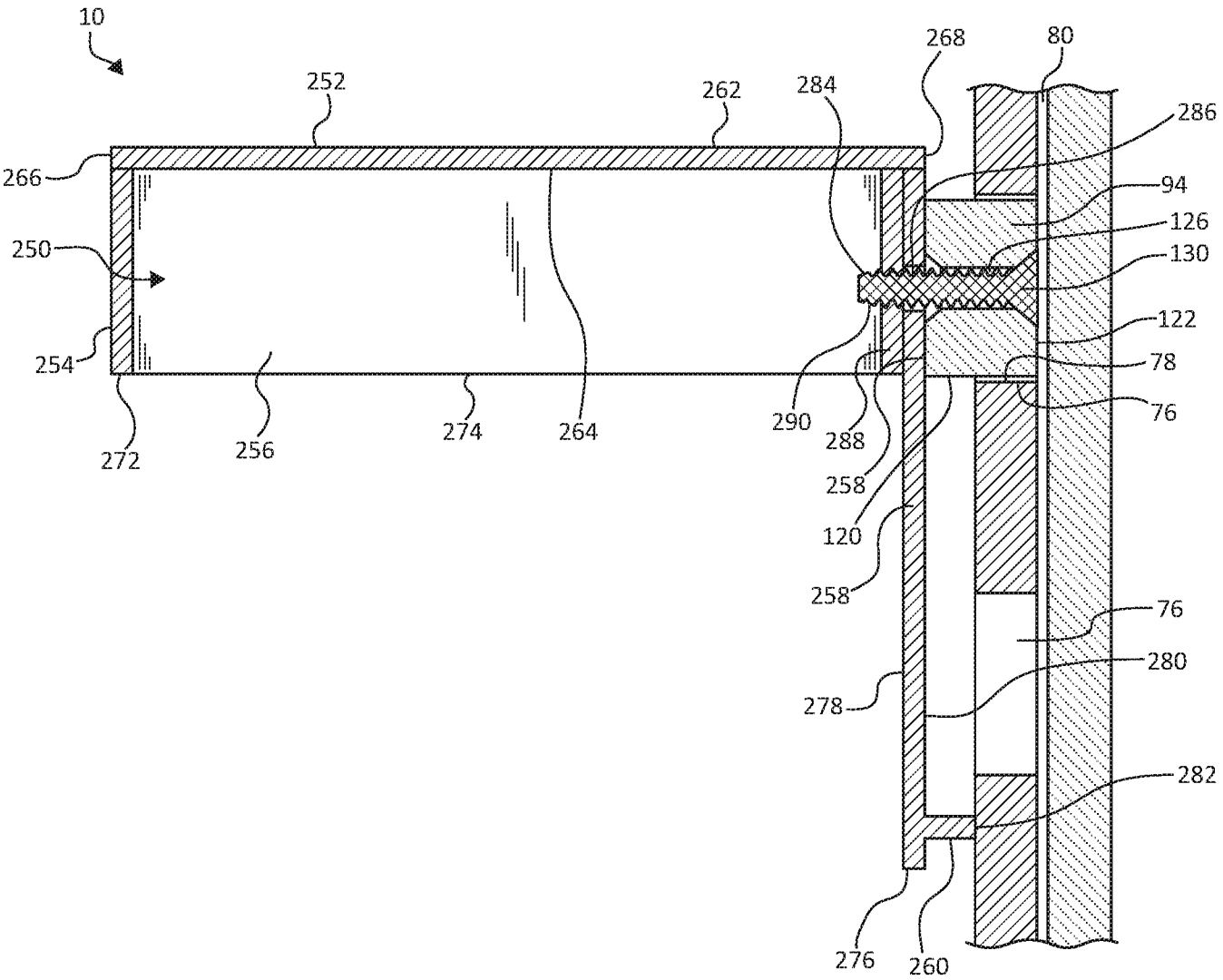
FIG. 15 is a cross-sectional view illustration taken along line XIII-XIII of FIG. 14, according to one embodiment of the present invention.

FIGS. 13-15, illustrate one embodiment of open shelf 250 configured for use with magnetic display system 11, as shown in FIG. 1. Open shelf 250 includes a top-facing wall 252, a front wall 254, sidewalls 256, a back wall 258, and an offset segment such as a flange 260, in one embodiment. In one example, each of top-facing wall 252, front wall 254, sidewalls 256, back wall 258 is formed of a substantially planar member, such as aluminum, polycarbonate, etc. In one example, each of top-facing wall 252, front wall 254, sidewalls 256, back wall 258 is joined edge to edge to adjacent ones of top-facing wall 252, front wall 254, sidewalls 256, back wall 258 rigid shelf. In other examples, one or more of front wall 254, sidewalls 256, back wall 258 are eliminated.

Top-facing wall 252 defines a top surface 262 and an opposite bottom surface 264 (FIG. 15) each connected by a front edge 266, a rear edge 268 opposite front edge 266, and side edges 270 extending between front edge 266 and rear edge 1268 opposite one another. Front wall 254 extends downwardly from front edge 266 to a bottom edge 272. Sidewalls 256 each extend downwardly from a different one of side edges 270 to a bottom edge 274, and back wall 258 extends downwardly from rear edge 268 to a bottom edge 276. In one example, each of bottom edge 272 of front wall 254 and bottom edges 274 of sidewalls 256 are located a similar distance from top-facing wall 252, while, in one embodiment, bottom edge 276 of back wall 258 extends downwardly further from top-facing wall 252 than any of bottom edges 272 and 274.

Back wall 258 is configured to facilitate selective coupling of open shelf 250 with magnetic focal wall 14. Back wall 258 is substantially planar, in one embodiment, defining a front surface 278 and a rear surface 280 facing in an opposite direction as front surface 278. In one example, an auxiliary plate 288, which, in one embodiment, is substantially similar to front plate 226 and has a length extending substantially entirely between sidewalls 256. Collective apertures 284 are positioned along back wall 258 where a magnet 94 will be coupled thereto. Each collective aperture 284 is formed by an aperture 286 extending entirely through back wall 258 and a cavity 290 extending from a rear surface of auxiliary plate 288 partially into auxiliary plate 288, in one example. Collective aperture 284 is threaded in one embodiment, to receive screw 130 as thread through magnet 94 to couple magnet 94 to back wall 258 in a similar manner as magnets are coupled to support bar bracket 150. In one example, two or more, for instance, three or more, magnets 94 are similarly attached to back wall 258 and are placed along back wall 258 with a center-to-center spacing substantially identical to the center-to-center spacing of perforations 76 in a linear row of perforated panel 52.

In one example, flange 260 extends from rear surface 280 of back wall 258 near bottom edge 276 rearwardly to a free edge 282 to provide an offset between front surface 70 of perforated panel 52 and back surface 280 of back wall 258 to compliment the offset between front surface 60 of magnetic panel 50 and back surface 280 caused by a length of magnet 94 during use (see, e.g., FIG. 15) such that when coupled with magnetic focal wall 14, back wall 258 extends substantially vertically. In addition, flange 260 generally decreases any undesired rotation or tilt of open shelf 250 about magnets 94.

Open shelf 250 is coupled to magnetic focal wall 14 by aligning and then moving each of the magnets 94 with two spaced apart perforations 76. Referring to FIGS. 13 and 14 and the corresponding cross-section of FIG. 15 taken about the line XIII-XIII, when each of magnets 94 is positioned in one of perforations 76, where each of those perforations 76 are in the same linear row of the array accordingly to one embodiment, free edge 282 of flange 260 contacts front surface 70 of perforated panel 52 in a manner preventing or at least decreasing undesired tilting or rotating of open shelf 250 about magnets 94. Since open shelf 250, like peg 90, uses the magnetic force between magnets 94 and magnetic focal wall 14 to and the vertical force of perforation perimeter edge 78 against magnet 94, open shelf 250, like peg 90 is readily reconfigurable. Magnet 94 once again is of sufficient strength to maintain open shelf 250 coupled to magnetic focal wall 14 when supporting one or more products 18, but to allow a user pulling on open shelf 250 to readily remove open shelf 250 without the use of tools.

Figure 16:
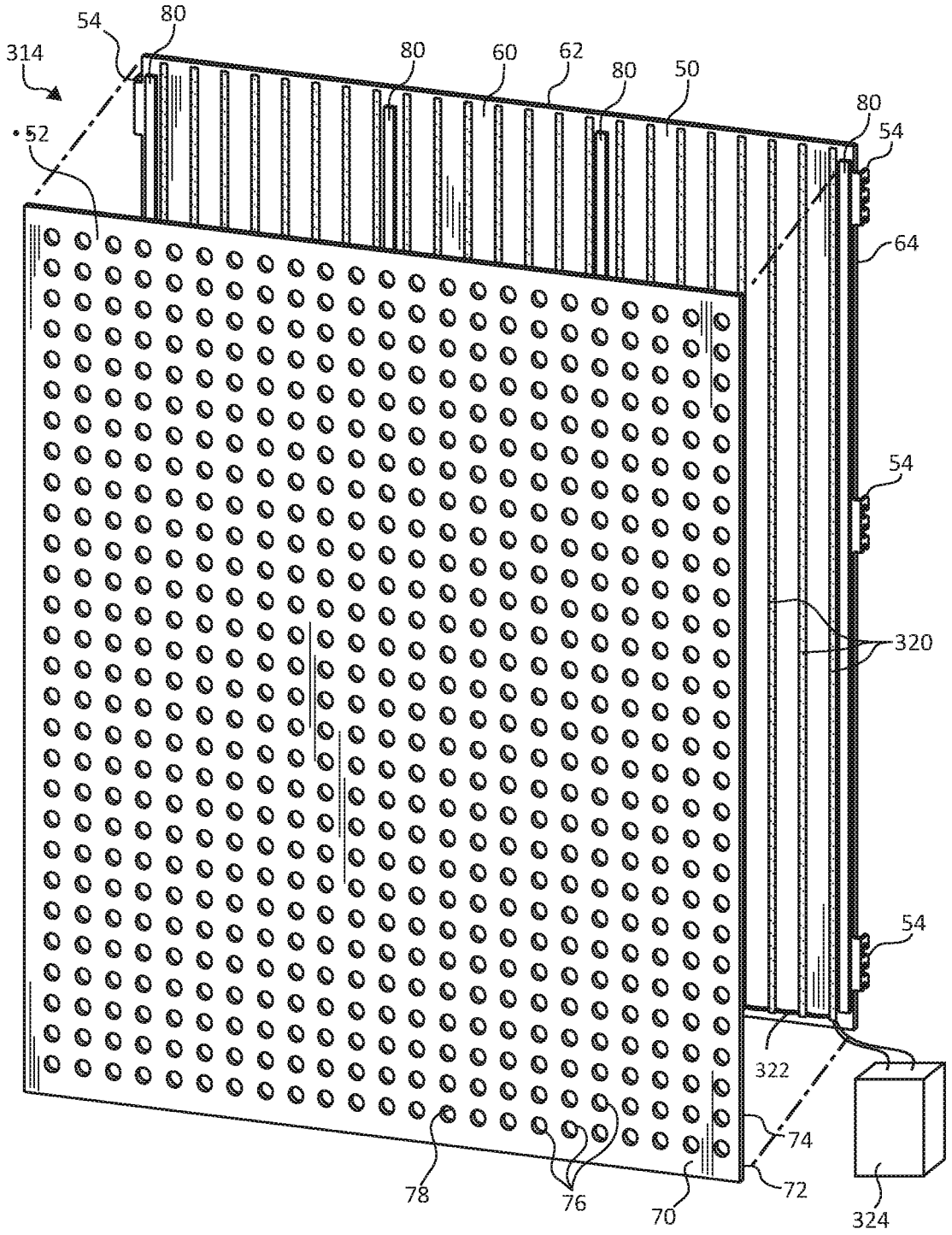
FIG. 16 is a front perspective view illustration of a back support, according to one embodiment of the present invention.

FIG. 16 illustrates one embodiment of a magnetic focal wall 314, which is largely similar to magnetic focal wall 14, as partially denoted by the like reference numerals in FIG. 16 including magnetic panel 50 and perforated panel 352, but additionally includes electrical contact strips 320 wired to each other via one or more electrical connectors 322 and/or to any suitable power source 324, such as an alternating current or a direct current power supply. As such, power from power source 324 flows through the one or more electrical connectors 322 to and through each electrical contact strip 320. In one embodiment, each of electrical contact strips 320 vertically extends along front surface 60 of magnetic panel 50 between magnetic panel 50 and perforated panel 352. Each electrical contact strip 320 is further positioned to align with a row of perforations of the array of perforations 76. In this manner, each electrical contact strip is exposed through a perforation of the array of perforations 76. In magnetic focal wall 314, perforated panel 352 is substantially similar to perforated panel 52, described above, but in one embodiment, is formed of a material configured to provide an electrical ground to magnetic focal wall 314.

Figure 17:
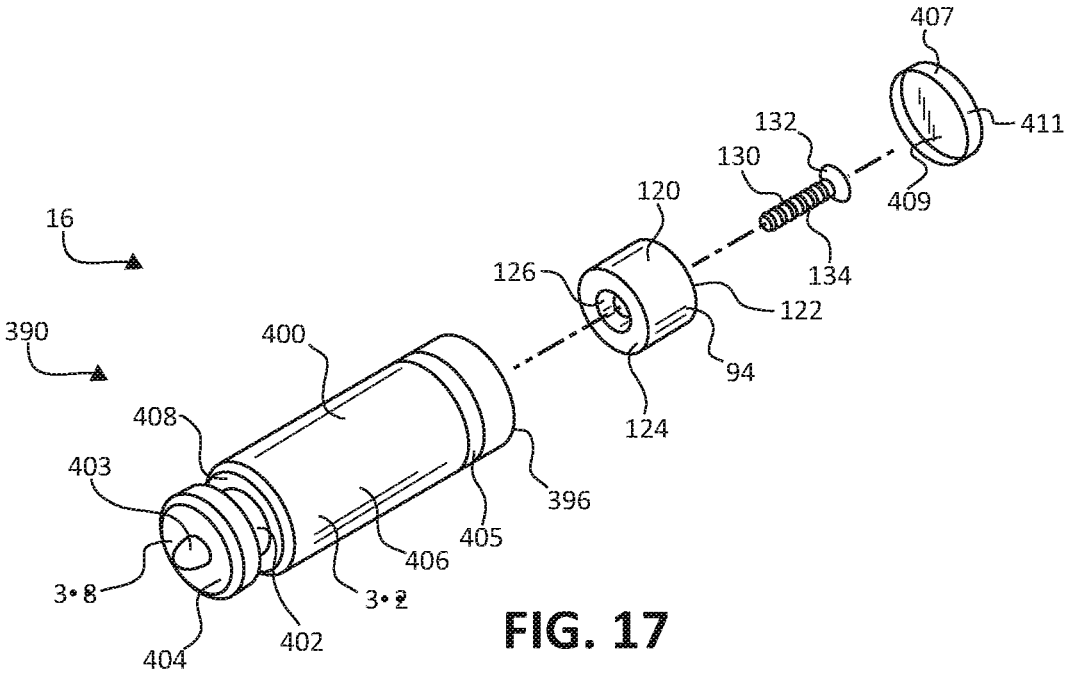
FIG. 17 is an exploded, front perspective view illustration of a support puck for use with the back support of FIG. 16, according to one embodiment of the present invention.
Figure 18:
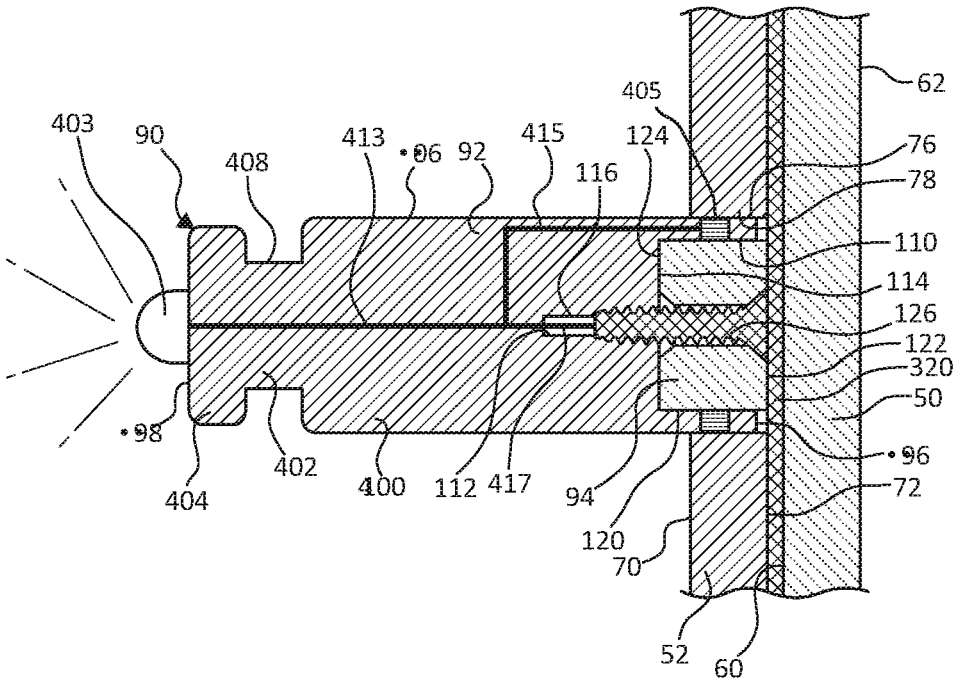
FIG. 18 is a cross-sectional view illustration of the support puck of FIG. 17 received by the back support of FIG. 16 taken through the longitudinal center of support puck, according to one embodiment of the present invention.

An electrical peg 390 for use with magnetic focal wall 314 is illustrated, according to one embodiment, in FIGS. 17 and 18. Electrical peg 390 includes a rear end 396 and a front end 398 opposite the rear end 96. Electrical peg 390 further includes a primary body 392 and a magnet 94. Primary body 392 is elongated to extend from rear end 396 toward and in one example, to front end 3398. Primary body 392 includes an elongated segment, such as a cylinder 400 in the illustrated embodiments, a neck 402, and an end cap 404. Elongated segment is shaped and sized to have a cross-section substantially identical, but slightly smaller than, a shape of one perforation of the array of perforations 76, as illustrated for one embodiment with additional reference to FIG. 18. For instance, in one example, elongated segment is a cylinder 400 where each of the array of perforations 76 are circular having an outside surface 406.

Neck 402 extends from a frontmost end of cylinder 400 forward toward front end 398. Neck 402 extends from cylinder 400 with a cross-sectional size that is smaller than cylinder 400 forward to end cap 404. End cap 404 is sized and shaped to be larger than neck 402, for example, to have a similar shape and size closer to that of cylinder 400 than neck 402. Primary body 392 defines a circumferential groove 408 about neck 402 between cylinder 400 and end cap 404. In one example, circumferential groove 408 is configured to receive a portion of a product 18 (see FIG. 1) to be hung therefrom, for example, a portion of a necklace, a strap of a handbag or other bag, or a hook of a hanger (not shown). End cap 404 is configured to generally prevent inadvertent movement of a corresponding product 18, e.g., such as sliding, off of peg 390.

In one example, cylinder 400 defines a primary cavity 110 and a secondary cavity 112 generally in the same manner as cylinder 100 such that primary cavity 110 receives magnet 94, and secondary cavity 112 threadably receives screw 130 or other suitable coupling member. In addition, in one embodiment, cylinder 400 includes a terminal ring 405 having a negative polarity. In one example, terminal ring 405 is in contact with primary cavity 110 so as to contact magnet 94.

Cylinder 400, in one embodiment, includes an electrically charged element on front end 98 thereof, such as an LED 403 or other illumination device. LED 403 is electrically connected to screw 130 and/or otherwise tied to a back end 396 of cylinder. In one embodiment, electrical wires 413 extend through cylinder 400 to secondary cavity 112 to contact screw 130, which is an electrical conductor. A ground wire 415 extends within cylinder between terminal ring 405 and electrical wire 403 and/or screw 130. A socket or other interface 417 in electrical communication with electrical wires 413 may be formed at an end of secondary cavity 112 to facilitate electrical contact with screw 130.

In one embodiment, electrical peg 90 includes a back cap 407 configured to cap a rear end 396 of cylinder 400 and provide an increased area for electrical coupling. Back cap 407 is conductive, and, in one embodiment, is panel like have an end wall 409 and a perimeter skirt 411 extending forwardly therefrom. Back cap 407 is placed on cylinder 400 such that perimeter skirt surrounds a portion of rear end 396 of cylinder 400 and end wall 409 both is in electrical communication with electrical wires 413, for example, via screw 130, and/or forms the back most surface of electrical peg 90.

Primarily referring to FIG. 18, during use, electrical peg 390 is placed in one of perforations 76 of magnetic focal wall 314 much like peg 90 is placed in one of perforations 76 of magnetic focal wall 14 (FIG. 1). However, when so placed, electrical peg 390 is placed in electrical communication with electrical contact strips 320 and terminal ring 405 is placed in direct contact with a perforation perimeter edge 78 to provide ground-to-ground contact. In one example, electrical peg 390 is placed in electrical communication with electrical contact strips 320 via direct contact between back cap 407 and electrical contact strips 320 within or just behind a corresponding one of perforations 76. In this manner, when electrical peg 390 is used with magnetic focal wall 314, LED 403 is illuminated when power source 324 is on creating additional visual interest to the display. In one embodiment, LEDs or other electrically activated members can also be similarly included on other auxiliary support members 16, as will be apparent to those of skill in the art upon reading the present application.

Accordingly, embodiments of the invention described above, provide a reconfigurable display system using magnetic couplings with a magnetic panel to couple and recouple various auxiliary support members to a substantially vertical panel with sufficient strength to support a wide variety of products or other items. Magnetic couplings provide for ease, and, in one embodiment, tool-free decoupling and reconfiguration of the display system. In one embodiment, auxiliary support members additional including electrical components that become electrically activated when coupled with the magnetic panel.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A retail display fixture comprising: a magnetic focal wall including:

a magnetic panel being substantially planar and producing a magnetic field, the magnetic panel defining a front surface, and a perforated pegboard panel being substantially planar and defining a plurality of perforations extending entirely through the perforated pegboard panel, each of the plurality of perforations is of a substantially identical size and shape, wherein the perforated pegboard panel is coupled with the magnetic panel such that the perforated pegboard panel extends in a substantially parallel plane with and is positioned in front of the magnetic panel, and the magnetic panel extends behind each of the plurality of perforations; and a cylindrical auxiliary support peg configured to support a product thereon away from the magnetic focal wall, the auxiliary support peg including a cavity formed within a rear end of the auxiliary support peg, a magnet nested within the cavity and secured to the auxiliary support peg by a fastener that extends through the magnet, wherein the rear end of the auxiliary support peg is sized to fit within any one of the plurality of perforations such that the magnet of the auxiliary peg is magnetically coupled with the magnetic panel through one of the plurality of perforations and the auxiliary support peg extends forwardly from the perforated pegboard panel supported solely by the magnetic focal wall.

2. The retail display fixture of claim 1, wherein:

the plurality of perforations is an array of perforations including substantially linear rows and substantially linear columns of perforations.

3. The retail display fixture of claim 1, wherein the perforation pegboard panel is characterized by an absence of magnetism.

4. The retail display fixture of claim 1, wherein each perforation of the plurality of perforations defines a perforation perimeter edge contacting an outside surface of the auxiliary support peg to supplement a magnetic coupling between the auxiliary support peg and the magnetic focal wall.

5. The retail display fixture of claim 1, in combination with a product hung from the auxiliary support peg.

6. The retail display fixture of claim 1, wherein the magnetic focal wall includes an adhesive tape coupling the magnetic panel to the perforated pegboard panel.

7. The retail display fixture of claim 6, wherein the adhesive tape is an adhesive foam tape coupled directly to the perforation pegboard panel and the magnetic panel and spacing the perforation pegboard panel from the magnetic panel such that the perforation pegboard panel contacts the auxiliary support peg forwardly from the magnetic panel.

8. The retail display fixture of claim 7, wherein the magnetic panel and the perforated pegboard panel are positioned to extend substantially coplanarly with one another.

9. The retail display fixture of claim 1, wherein the magnetic focal wall additionally includes an electrical contact strip positioned between the magnetic panel and the perforated pegboard panel such that the electrical contact strip is exposed through the perforated pegboard panel via corresponding perforations.

10. The retail display fixture of claim 9, wherein:

the auxiliary support peg additionally includes:

an electrically powered feature on a front end of the auxiliary support peg, and an electrical contact, the electrical contact being in electrical contact with the electrical contact strip when the auxiliary support peg is magnetically coupled to the magnetic focal wall.

11. The retail display fixture of claim 10, wherein the perforated pegboard panel is an electrical ground and contacts an electrical ground included on the auxiliary support peg.

12. The retail display fixture of claim 10, further comprising a power source providing electrical current to the electrical contact strip, wherein when the power source is turned on and the auxiliary support peg is magnetically coupled with the magnetic focal wall, the electrically powered feature is activated.

13. The retail display fixture of claim 12, wherein the electrical contact strip extends at least one of vertically being exposed via a column of the corresponding perforations and horizontally being exposed via a row of the corresponding perforations.

14. The retail display fixture of claim 12, wherein the electrically powered feature is a light, and the light is illuminated when the power source is turned on and the auxiliary support peg is magnetically coupled with the magnetic panel.

15. The retail display fixture of claim 1, wherein the auxiliary support peg includes a circumferential groove opposite the magnetic focal wall for receiving a product.

* * * * *